US005143231A

United States Patent [19]

Chang

[11] Patent Number: 5,143,231

[45] Date of Patent: Sep. 1, 1992

[54] PROP

[76] Inventor: R. J. Chang, No. 70, Lane 61, Chung Shan Rd., Sha Lu Town, Taichung Hsien, Taiwan

[21] Appl. No.: 751,790

[22] Filed: Aug. 29, 1991

[51] Int. Cl.[5] ..... A47F 5/00

[52] U.S. Cl. ..... 211/96; 211/168

[58] Field of Search ..... 211/96, 168, 87

[56] References Cited

U.S. PATENT DOCUMENTS

| | | | |
|---|---|---|---|
| 698,795 | 4/1902 | Burns | 211/96 |
| 761,893 | 6/1904 | Lee | 211/96 X |
| 1,525,533 | 2/1925 | Brown | 211/96 |
| 1,821,722 | 9/1931 | Neal | 211/96 X |
| 2,165,654 | 7/1939 | Rosenthal | 211/96 X |
| 2,802,577 | 8/1957 | Moore | 211/96 |
| 2,919,881 | 1/1960 | Eames | 211/96 X |

*Primary Examiner*—Robert W. Gibson, Jr.
*Attorney, Agent, or Firm*—Bacon & Thomas

[57] ABSTRACT

A prop comprising a wall plate fastened in a wall and a supporting frame revolvably fastened in said wall plate for holding garment hangers, wherein said supporting frame can be rotated on said wall plate and positioned at any of a variety of angular positions by fastened a key thereof in any of a variety of notches which are made on a horizontal wall extending from said wall plate around a circle. Spaced rings are fastened in the supporting frame for hanging garment hangers separately.

3 Claims, 4 Drawing Sheets

PROP

BACKGROUND OF THE INVENTION

The present invention relates to props and relates more particularly to a prop for holding garments outdoors for drying under the sun and wind which is comprised of a wall plate fastened in a wall and a main frame revolvably fastened in said wall plate for holding garment hangers. The main frame can be adjusted to any of a variety of angular positions on the wall plate by changing the key thereof in any of a variety of notches on the wall plate.

People who live in apartments generally use a balcony for drying clothes under the sun or wind. Due to limited space, elongated pole may be not suitable for hanging in a balcony for drying clothes under the sun or wind. Therefore, people tend to fasten a rope or wire in a balcony for holding clothes by clips or garment hangers. However, clothes may be moved to gather together easily under a strong wind force. When clothes are gathered together, they will be very difficult to be dried under the sun or wind. Further, when a rope, wire or any supporting means is fixedly fastened in place for holding clothes by garment hangers or clips, it can not be moved to a suitable angular position according to projecting angle of the direct sunlight so as to keep the clothes which are hung thereon in positions directly exposed to the sun.

SUMMARY OF THE INVENTION

The present invention has been accomplished under the circumstances in view. It is therefore an object of the present invention to provide a prop for drying clothes under the sun or wind which requires less space occupation in installation.

It is another object of the present invention to provide a prop for drying clothes under the sun or wind which can be conveniently fastened in the outside wall of a building and adjustably secured thereto at any of a variety of angular positions permitting the supporting frame thereof to be moved out of a building for drying clothes under the sun or wind or moved back inside a building for collecting the clothes hung thereon.

It is still another object of the present invention to provide a prop for drying clothes under the sun or wind which has a plurality of hanging rings spaced from one another for hanging garment hangers separately in place.

DETAILED DESCRIPTION OF THE PREFERRED EMBODIMENT

Figure 1:
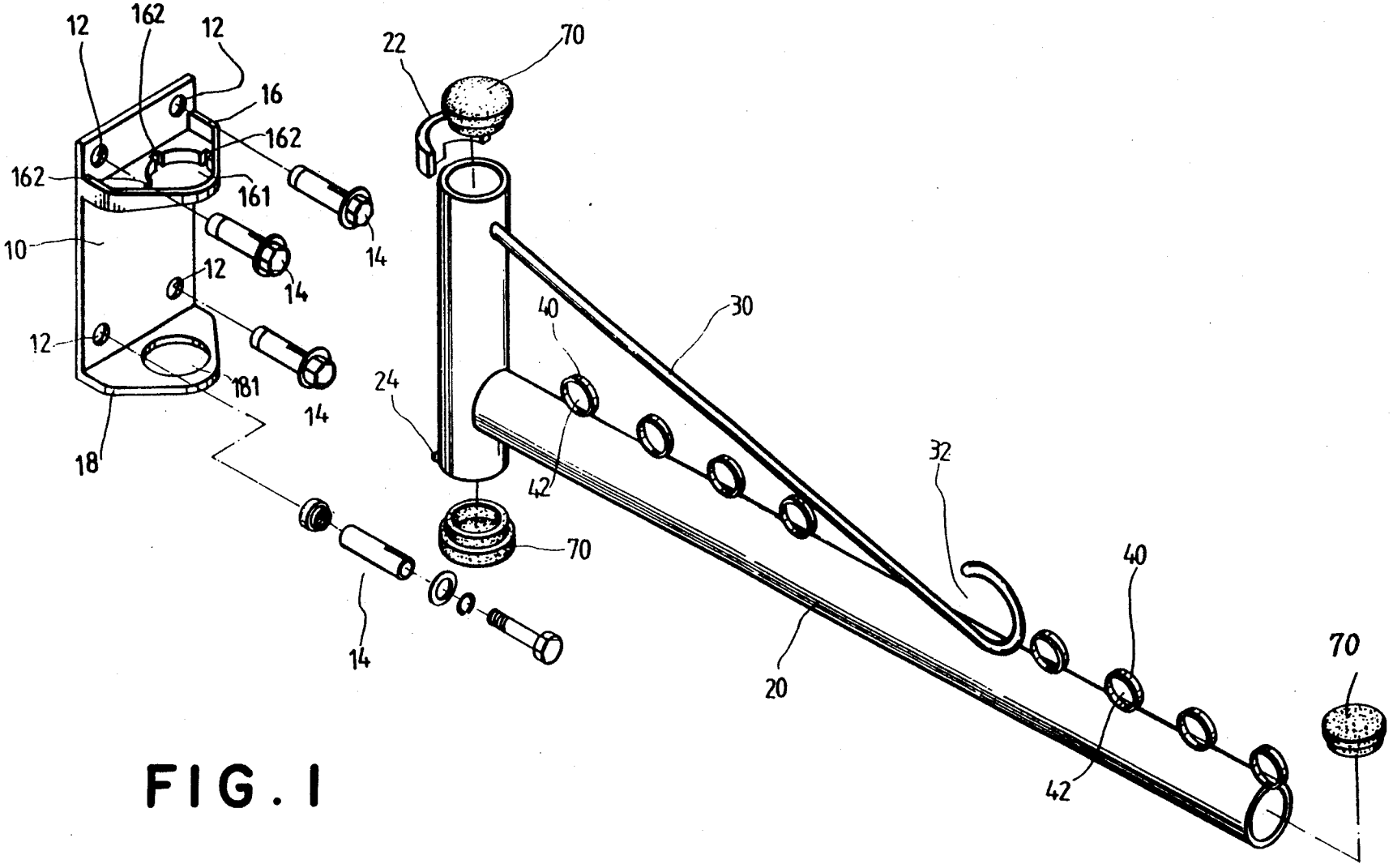
FIG. 1 is an exploded perspective view of the preferred embodiment of the prop of the present invention.
Figure 2:
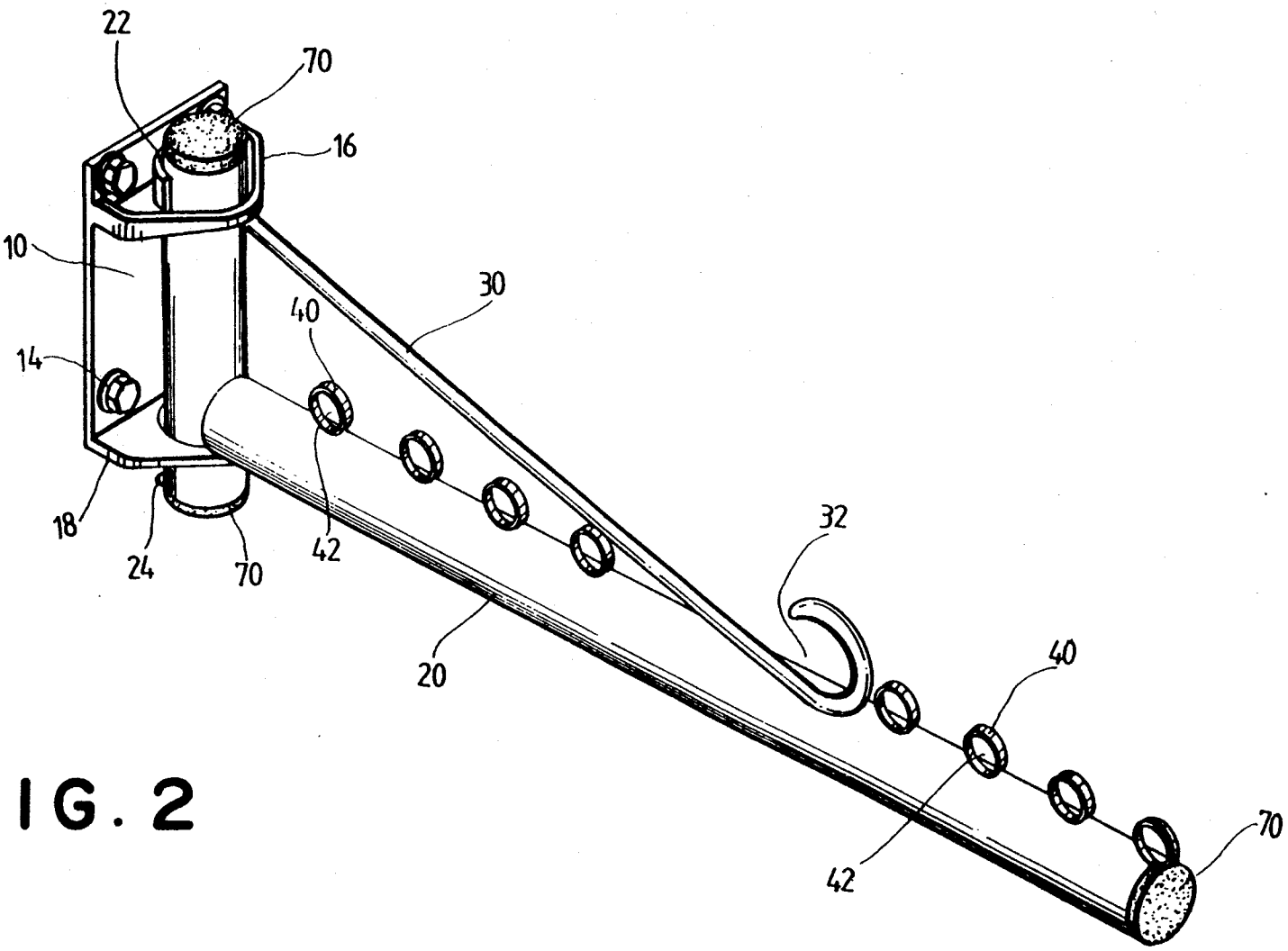
FIG. 2 is a perspective assembly view thereof.

Referring to FIGS. 1 and 2, therein illustrates is the preferred embodiment of the prop of the present invention which is generally comprised of a wall plate 10 which has a substantially -shaped cross section, a substantially L-shaped main frame 20, a reinforcing rod 30 and a plurality of rings 40.

The wall plate 10 is comprised of a vertical wall portion 101, which has a plurality of through-holes 12 made thereon through which the wall plate can be fastened in a wall by expansion bolts 14, a first horizontal wall portion 18 transversely extending from said vertical wall portion 101 at the bottom at one side and a second horizontal wall portion 16 transversely extending from said vertical wall portion 101 at the same side above said first horizontal wall portion 18 wherein said first and second horizontal wall portions 18, 16 each has a round hole 161 or 181 at the center aligned with each other for mounting the main frame 20; said second horizontal wall portion 16 further has a plurality of notches 162 made on the peripheral edge of the round hole 161 therein. The second horizontal wall portion 16 of the wall plate 10 is relatively thicker than the first horizontal wall portion 18 thereof and the end edge of the second horizontal wall portion 18 which is welded to the vertical wall portion 101 is thicker than the opposite end edge thereof which is spaced from the vertical wall portion 101. Through this arrangement, the structure of the wall plate 10 is reinforced against torsional force. The main frame 20 is comprised of short tube 201 inserted through the round holes 181, 161 on the first and second horizontal wall portions 18, 16 of the wall plate 10 and a long tube 202 attached to said short tube 201 at right angle and disposed between the first and second horizontal wall portions 18, 16 of the wall plate 10, wherein said short tube 201 has a key 22 attached to the peripheral surface thereof at the top through the process of welding and stopped above the second horizontal wall portion 16 of the wall plate 10, and a stop plate 24 attached to the peripheral surface thereof at the bottom through the process of welding and stopped below the first horizontal wall portion 18 of the wall plate 10. By means of the arrangement of the key 22 and the stop plate 24, the main frame 20 is revolvably retained in the wall plate 10. The reinforcing rod 30 has one end fixedly fastened in the short tube 201 at an upper location and an opposite end bent into a hook 32 and attached to the surface of the long tube 202. The rings 40 are respectively attached to the long tube 202 at suitable locations through the process of welding, each of which has a hole 42 disposed to the outside for hanging a garment hanger 50.

Figure 3:
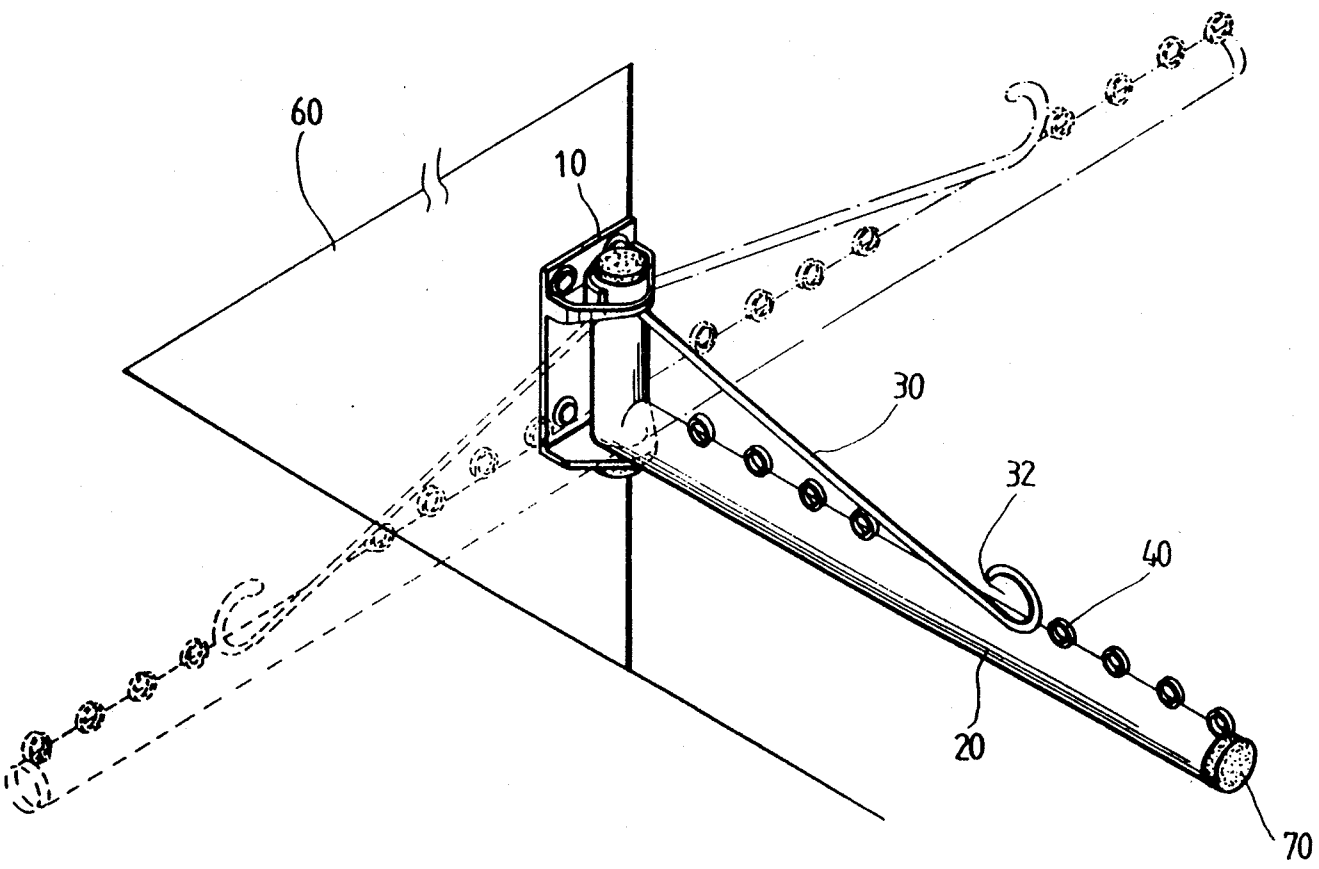
FIG. 3 illustrates that the main frame can be rotated on the wall plate and alternatively set at any of a variety of angular positions defined by the notches on the round hole on the second horizontal wall portion of the wall plate.

Referring to FIG. 3, the wall plate 10 is fastened in a wall 60 to hold the main frame 20. By engaging the key 22 in either notch 162 on the round hole 161 of the second horizontal wall portion 16 of the wall plate 10, the angular position of the main frame 20 relative to the wall 60 is changed.

Figure 4:
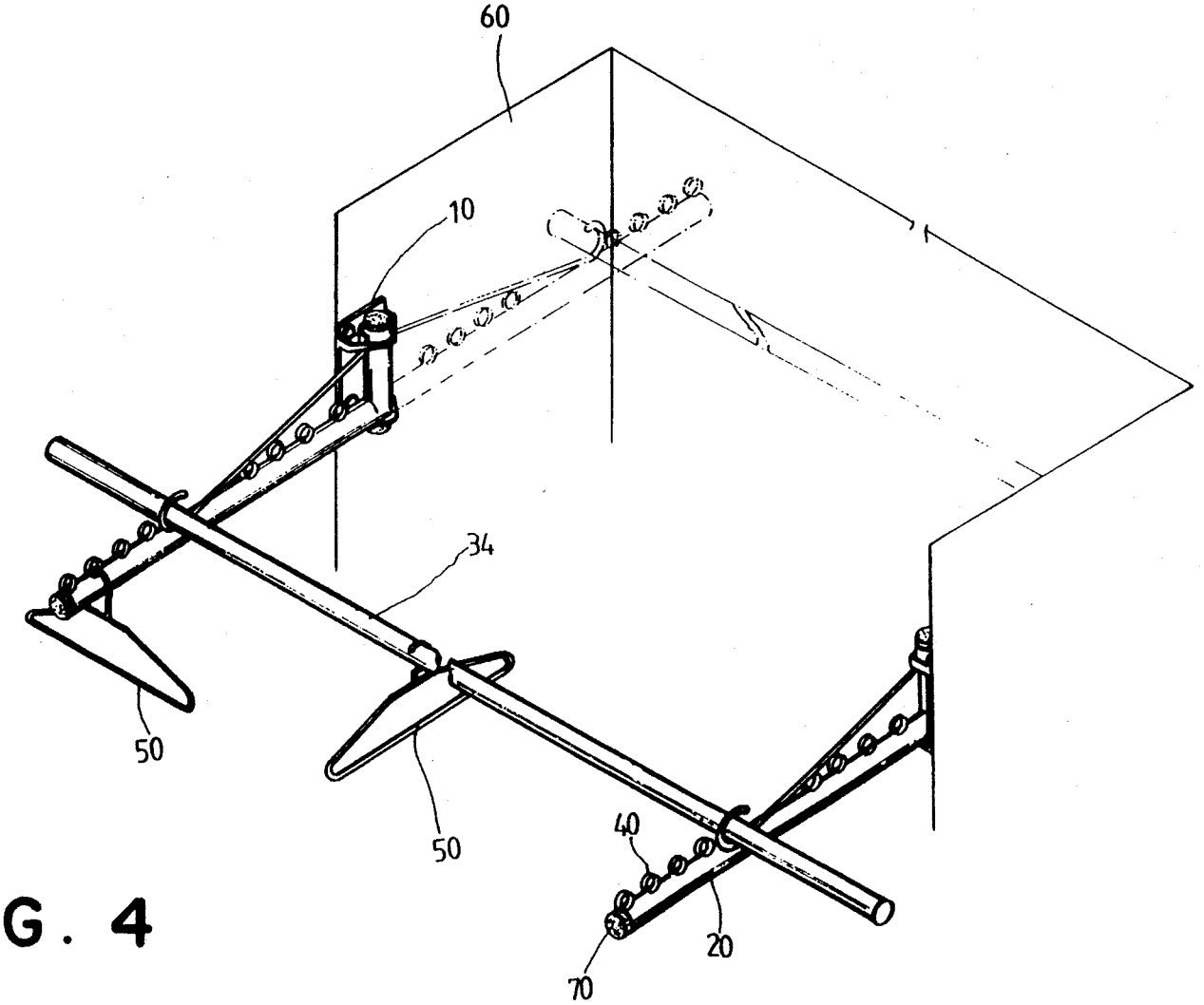
FIG. 4 illustrates an example of application of the present invention.

Referring to FIG. 4, two props of the present invention may be simultaneously fastened in a wall or a supporting structure at two opposite locations with the hooks of the reinforcing rods thereof disposed for holding an elongated rod 34 therebetween. Because the reinforcing rod on each prop is obliquely extending from the short tube to the long tube thereof, placing the elongated rod 34 on the reinforcing rods of the two props causes the elongated rod 34 to automatically fall into the hooks of the reinforcing rods of the props.

Further, because the main frame 20 is comprised of a short tube 201 and a long tube 202, the terminal ends of the short and long tubes 201, 202 must be sealed by sealing 70 for protection against moisture.

What is claimed is:

1. A prop comprising:

a) a wall plate including a vertical wall portion for attachment to a wall, first and second horizontal wall portions extending transversely from the vertical wall portion, a hole formed in the second horizontal wall portion and a plurality of notches formed around the periphery of the hole;

b) the second horizontal wall portion being relatively thicker than the first horizontal wall portion, the second horizontal wall portion including a first end portion welded to the vertical wall portion and a second end portion spaced from the vertical wall portion, and the first end portion being thicker than the second end portion;

c) a main frame for holding garment hangers, the main frame including a short vertical rod rotatably secured to the first and second horizontal wall portions and through the hole, and a long horizontal rod extending from a lower portion of the short vertical rod and forming a right angle therewith; and d) a key secured to the short vertical rod for selective engagement in anyone of the plurality of notches to establish the angular position of the main frame relative to the wall plate.

2. A prop comprising:

a) a wall plate including a vertical wall portion for attachment to a wall, first and second horizontal wall portions extending transversely from the vertical wall portion, a hole formed in the second horizontal wall portion and a plurality of notches formed around the periphery of the hole;

b) a main frame for holding garment hangers, the main frame including a short vertical rod rotatably secured to the first and second horizontal wall portions and through the hole, and a long horizontal rod extending from a lower portion of the short vertical rod and forming a right angle therewith;

c) a plurality of spaced rings welded to the long horizontal rod for engagement by garment hangers; and d) a key secured to the short vertical rod for selective engagement in any one of the plurality of notches to establish the angular position of the main frame relative to the wall plate.

3. A prop comprising:

a) a wall plate including a vertical wall portion for attachment to a wall, first and second horizontal wall portions extending transversely from the vertical wall portion, a hole formed in the second horizontal wall portion and a plurality of notches formed around the periphery of the hole;

b) a main frame for holding garment hangers, the main frame including a short vertical rod rotatably secured to the first and second horizontal wall portions and through the hole, and a long horizontal rod extending from a lower portion of the short vertical rod and forming a right angle therewith;

c) a reinforcing rod including a first end secured to the short vertical rod at a top portion thereof and a second end in the configuration of a hook secured to the long horizontal rod; and d) a key secured t the short vertical rod for selective engagement in any one of the plurality of notches to establish the angular position of the main frame relative to the wall plate.

* * * * *